US010597269B2

(12) United States Patent
Huang

(10) Patent No.: US 10,597,269 B2
(45) Date of Patent: Mar. 24, 2020

(54) LIFT BASE WITH RETRACTABLE WHEELS

(71) Applicant: SHINN FU COMPANY OF AMERICA, INC., Kansas City, MO (US)

(72) Inventor: Steven Huang, Kansas City, MO (US)

(73) Assignee: SHINN FU COMPANY OF AMERICA, INC., Kansas City, MO (US)

( * ) Notice: Subject to any disclaimer, the term of this patent is extended or adjusted under 35 U.S.C. 154(b) by 97 days.

(21) Appl. No.: 16/109,270

(22) Filed: Aug. 22, 2018

(65) Prior Publication Data

US 2020/0062560 A1 Feb. 27, 2020

(51) Int. Cl.
*B66F 1/00* (2006.01)
*B66F 5/00* (2006.01)

(52) U.S. Cl.
CPC ..... *B66F 5/00* (2013.01)

(58) Field of Classification Search
CPC ..... B66F 5/00; B66F 5/02; B66F 7/00; B66F 7/246
See application file for complete search history.

(56) References Cited

U.S. PATENT DOCUMENTS

| | | | | |
|---|---|---|---|---|
| 3,633,774 | A * | 1/1972 | Lee | B62B 5/0083 414/809 |
| 3,751,007 | A * | 8/1973 | Hollerith | B66F 3/35 254/2 R |
| 5,507,509 | A * | 4/1996 | Della Polla, Jr. | B62B 3/04 269/133 |
| 6,241,227 | B1 * | 6/2001 | Berdan | B62B 3/108 254/10 R |
| 6,505,844 | B2 * | 1/2003 | Hallman | B62B 3/108 118/500 |
| 6,729,826 | B2 | 5/2004 | Brehmer et al. | |
| 8,740,190 | B2 | 6/2014 | Tijerina | |
| 9,273,818 | B2 | 3/2016 | Walton | |
| 2003/0034483 | A1 * | 2/2003 | Anderson | B66F 3/42 254/7 B |
| 2016/0069477 | A1 * | 3/2016 | Tabor | F16L 1/06 29/559 |

* cited by examiner

*Primary Examiner* — Lee D Wilson
(74) *Attorney, Agent, or Firm* — Lathrop GPM LLP

(57) ABSTRACT

A transportable jack system includes a jack disposed on a base. The base includes a base plate with a plurality of wheel openings formed therein, and a biasing member disposed between a wheel and the base plate. The biasing member is configured from a single piece of material consisting of a top horizontal portion, a bottom horizontal portion, and an angled middle portion disposed between the top horizontal portion and the bottom horizontal portion. The biasing member biases the base away from a ground surface when a load applied to the jack is below a predetermined threshold and deforms when the load is above the predetermined threshold, wherein the deformation allows the base plate to contact the ground surface.

20 Claims, 12 Drawing Sheets

LIFT BASE WITH RETRACTABLE WHEELS

FIELD OF THE INVENTION

The invention relates to vehicle jacks, lifts, and stands. More specifically, the invention is directed to a jack base having retractable wheels.

BACKGROUND

Vehicle jacks are ubiquitous. They are required by amateurs and professionals alike to service vehicles. Jacks are often heavy and difficult to move. Certain prior art jacks utilize wheels to try to make moving the jacks easier; however, a user is still required to support the weight of the jack while moving the jack. It would be desirable to have a jack that is easily movable from one location to another.

SUMMARY

The following presents a simplified summary of the invention to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In one embodiment, a transportable jack system includes a jack disposed on a base. The base includes a base plate with a plurality of wheel openings formed therein, and a biasing member disposed between a wheel and the base plate. The biasing member is configured from a single piece of material consisting of a top horizontal portion, a bottom horizontal portion, and an angled middle portion disposed between the top horizontal portion and the bottom horizontal portion. The biasing member biases the base away from a ground surface when a load applied to the jack is below a predetermined threshold and deforms when the load is above the predetermined threshold, wherein the deformation allows the base plate to contact the ground surface.

In another embodiment, a transportable base for a vehicle lift or jack includes a base plate having at least one wheel opening formed therein, and a biasing member disposed between a wheel and the base plate and secured to the base plate via a mechanical fastener. The biasing member consists of one piece of material forming a top substantially horizontal portion, a bottom substantially horizontal portion; and an angled middle portion between the top and bottom portions. The biasing member biases the base plate away from a ground surface when a load applied to the base plate is below a predetermined threshold, and deforms when the load applied to the base plate is above the predetermined threshold such that the base plate comes into contact with the ground surface.

In still another embodiment, a transportable base for a vehicle lift or jack, comprises a base plate; a connection member coupled to the base plate, the connection member comprising a base portion and a socket; a wheel assembly and a biasing member. The wheel assembly comprises a post having a shoulder; an attachment arm extending at least partially around the post; and a wheel coupled to the attachment arm. The post extends through an opening in the socket, and the biasing member is disposed between the shoulder and the socket and biases the wheel away from a ground surface when a load applied to the base plate is below a predetermined threshold. The biasing member compresses when the load applied to the base plate is above the predetermined threshold such that the base plate comes into contact with the ground surface.

DETAILED DESCRIPTION

Figure 1:
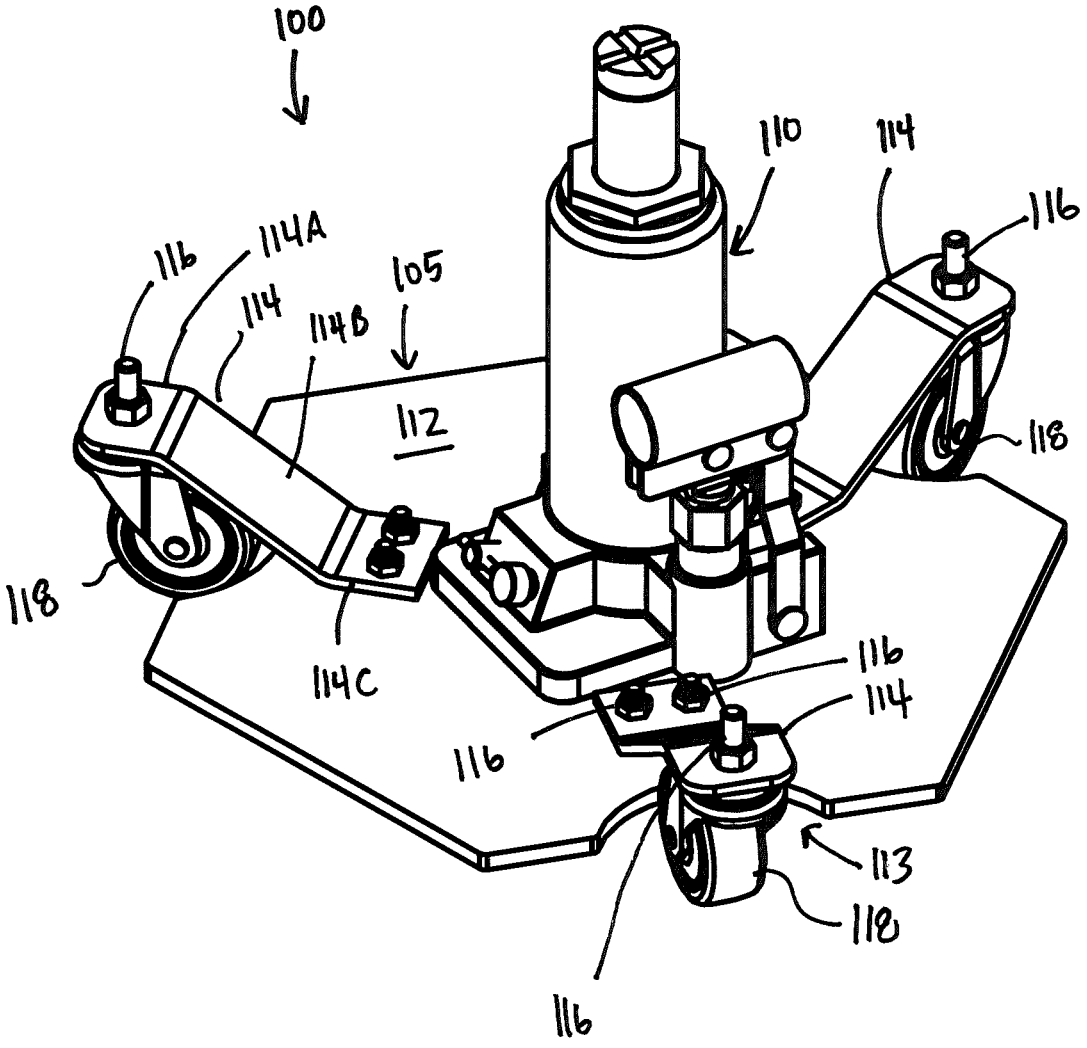
FIG. 1 is a perspective view of a vehicle lift disposed on a base having collapsible wheels according to an embodiment of the invention.
Figure 2:
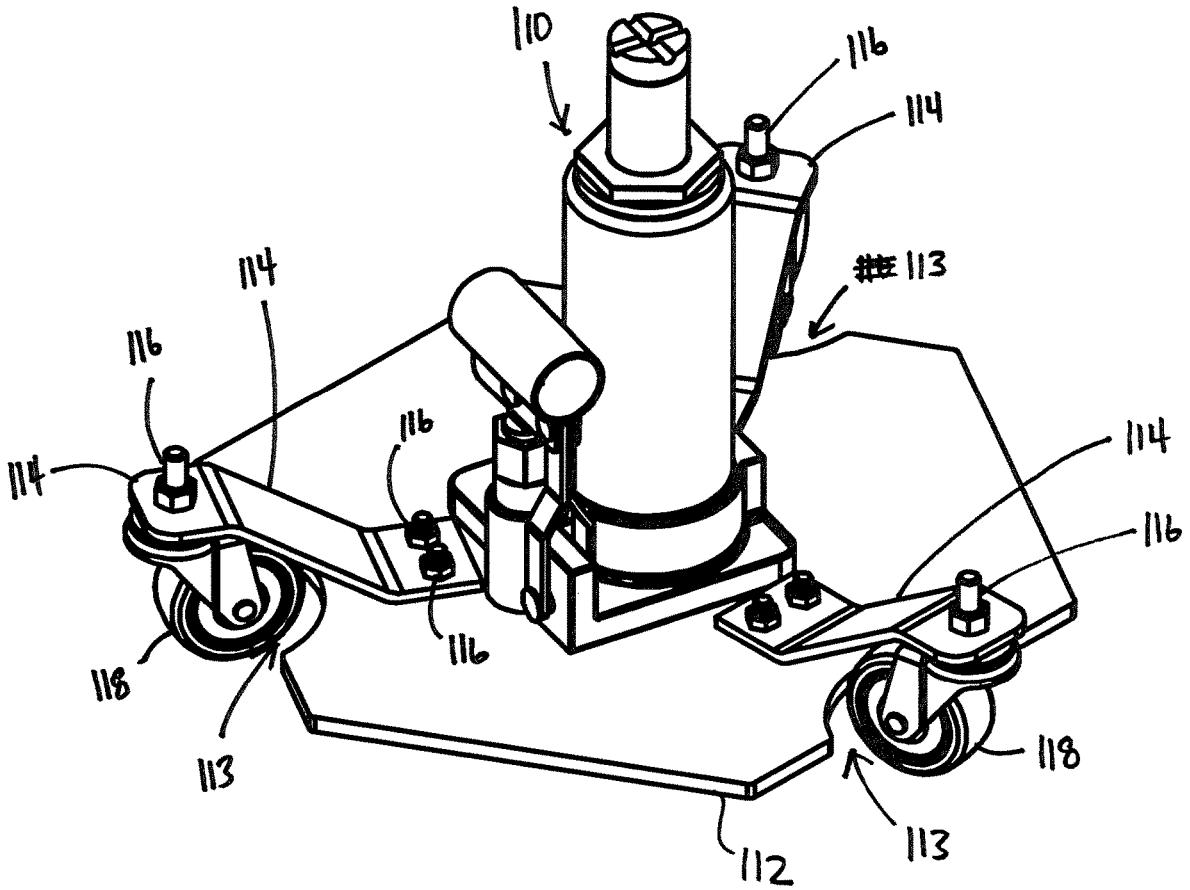
FIG. 2 is another perspective view of the vehicle lift disposed on the base having collapsible wheels of FIG. 1.
Figure 3:
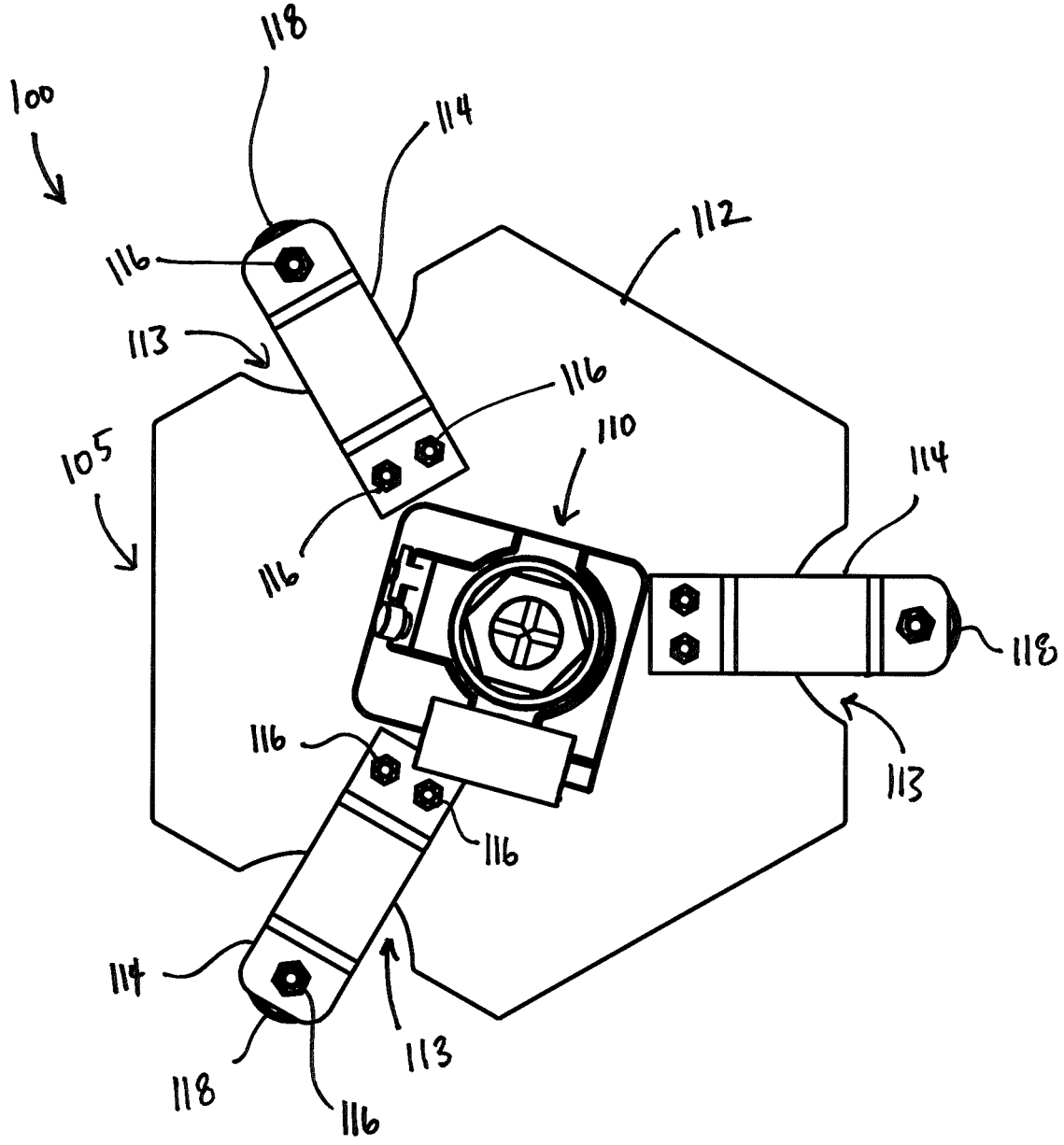
FIG. 3 is a top view of the vehicle lift and base of FIGS. 1 and 2.
Figure 4:
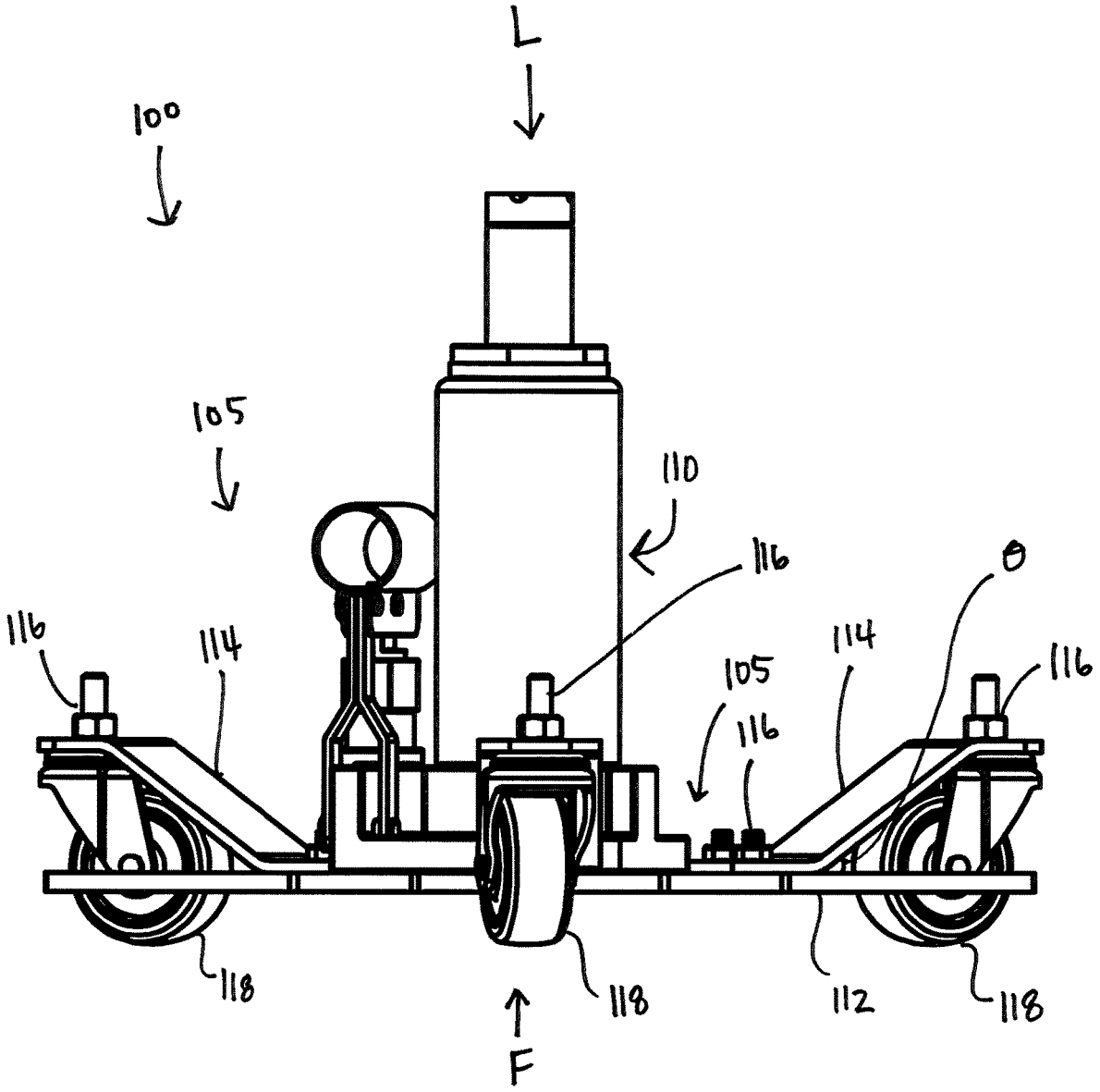
FIG. 4 is a side view of the vehicle lift and base of FIGS. 1 and 2.
Figure 5:
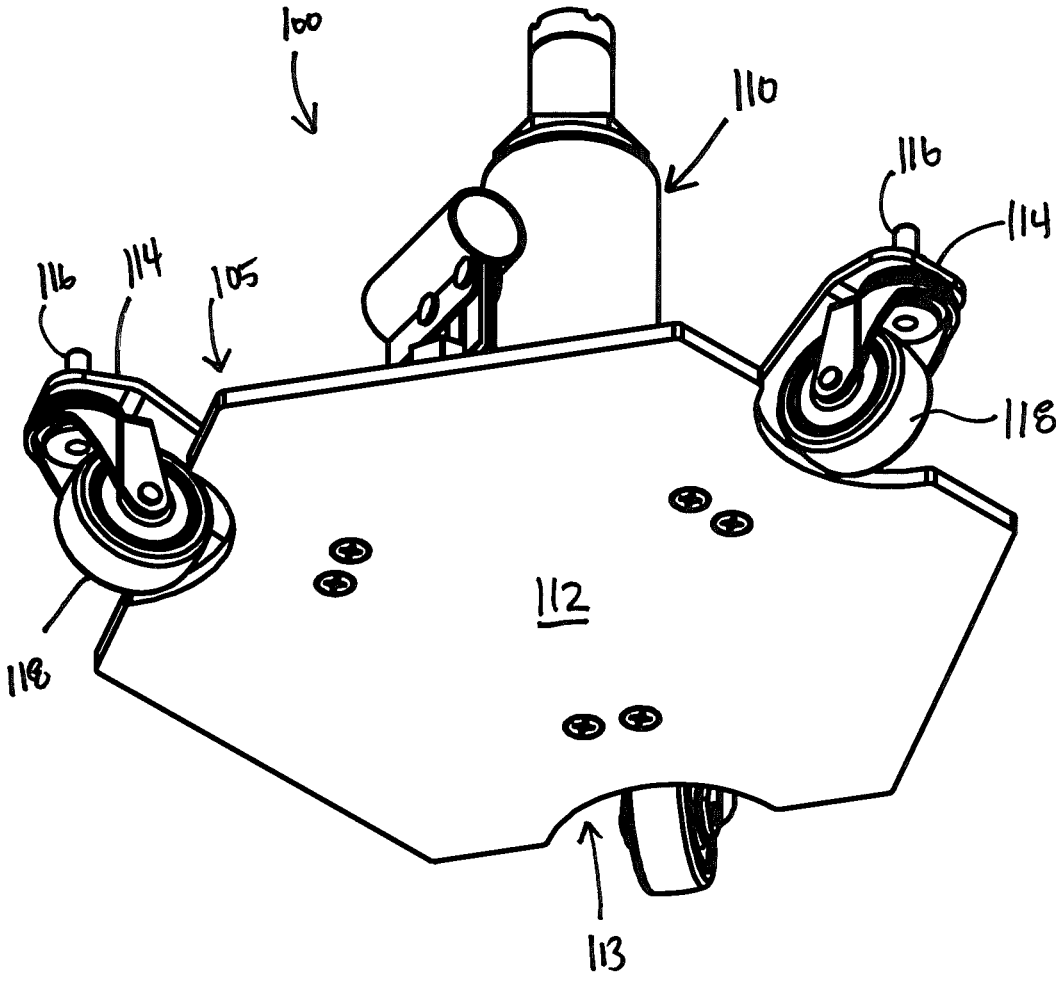
FIG. 5 is a bottom perspective view of the vehicle lift and base of FIGS. 1 and 2.
Figure 6:
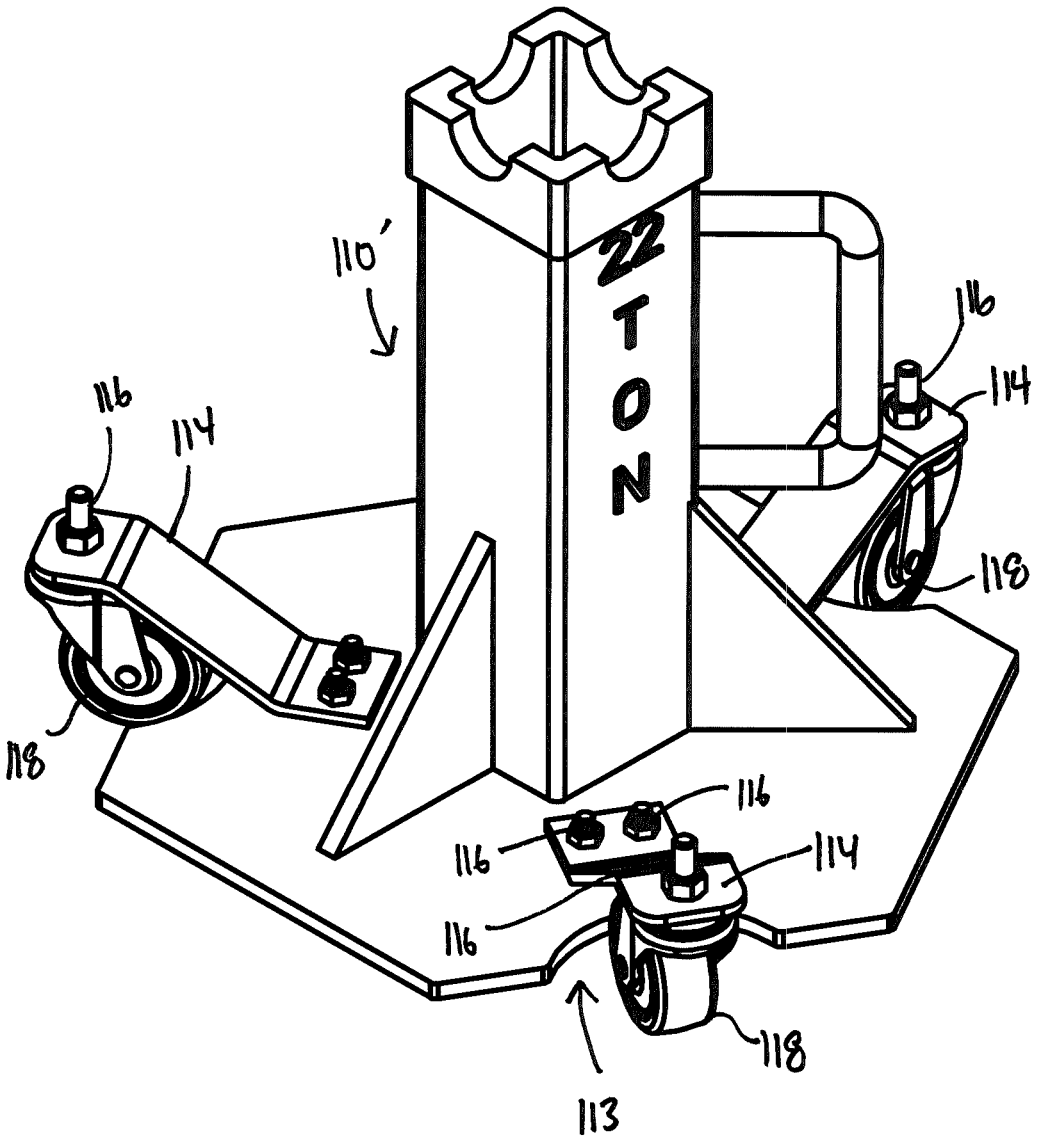
FIG. 6 is a perspective view of a vehicle support disposed on a base having collapsible wheels.
Figure 7:
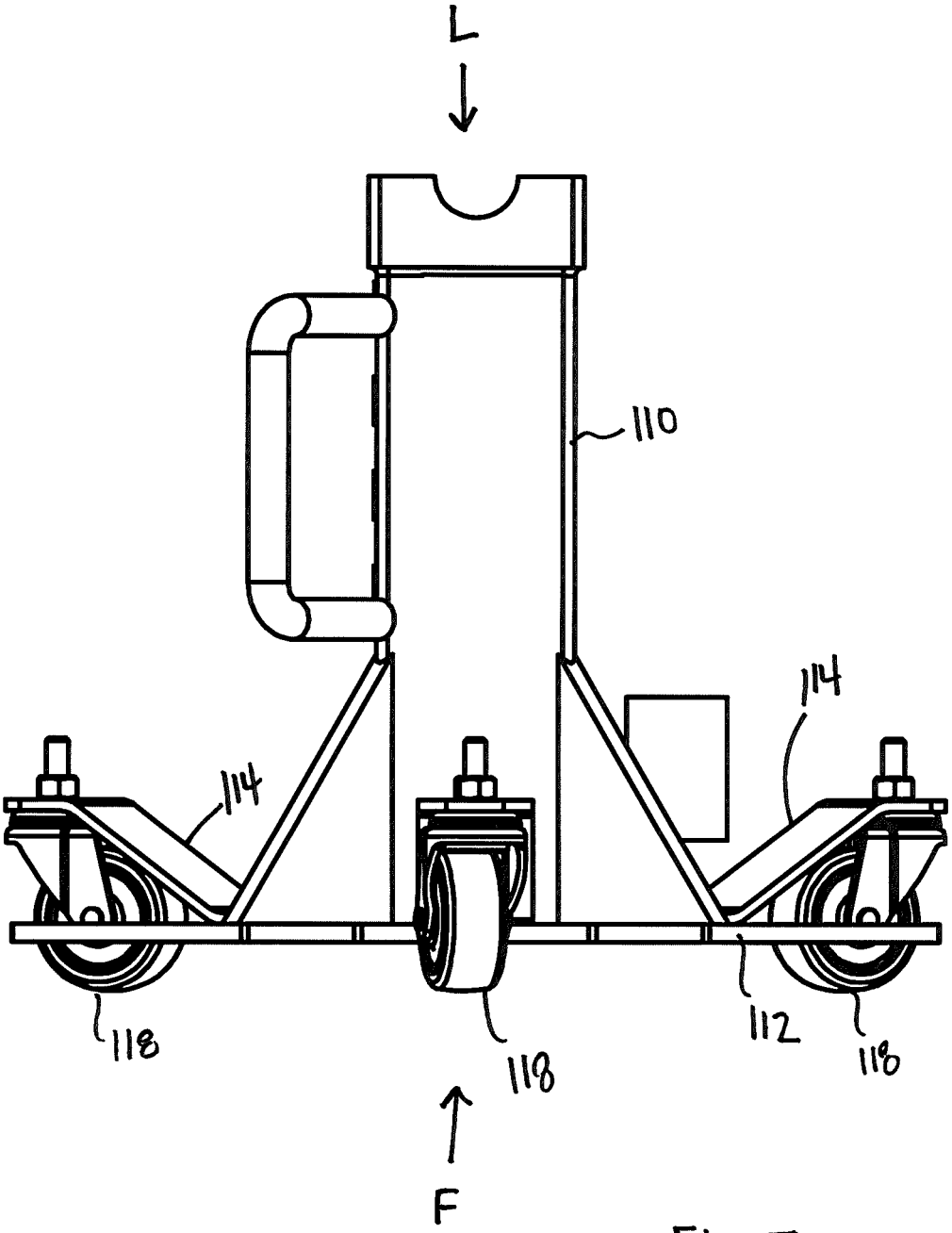
FIG. 7 is a side view of the vehicle support and base of FIG. 6.
Figure 8:
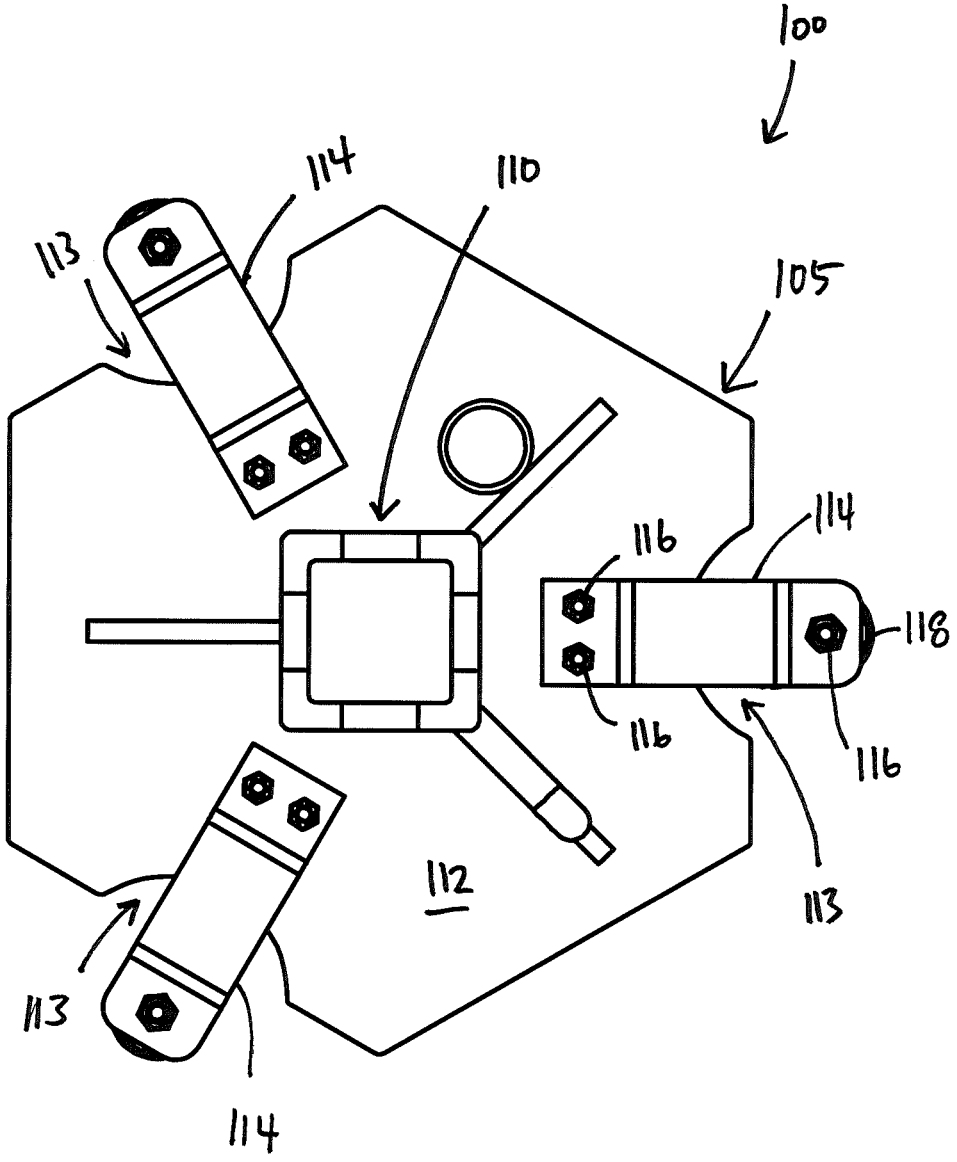
FIG. 8 is a top view of the vehicle support and base of FIG. 6.
Figure 9:
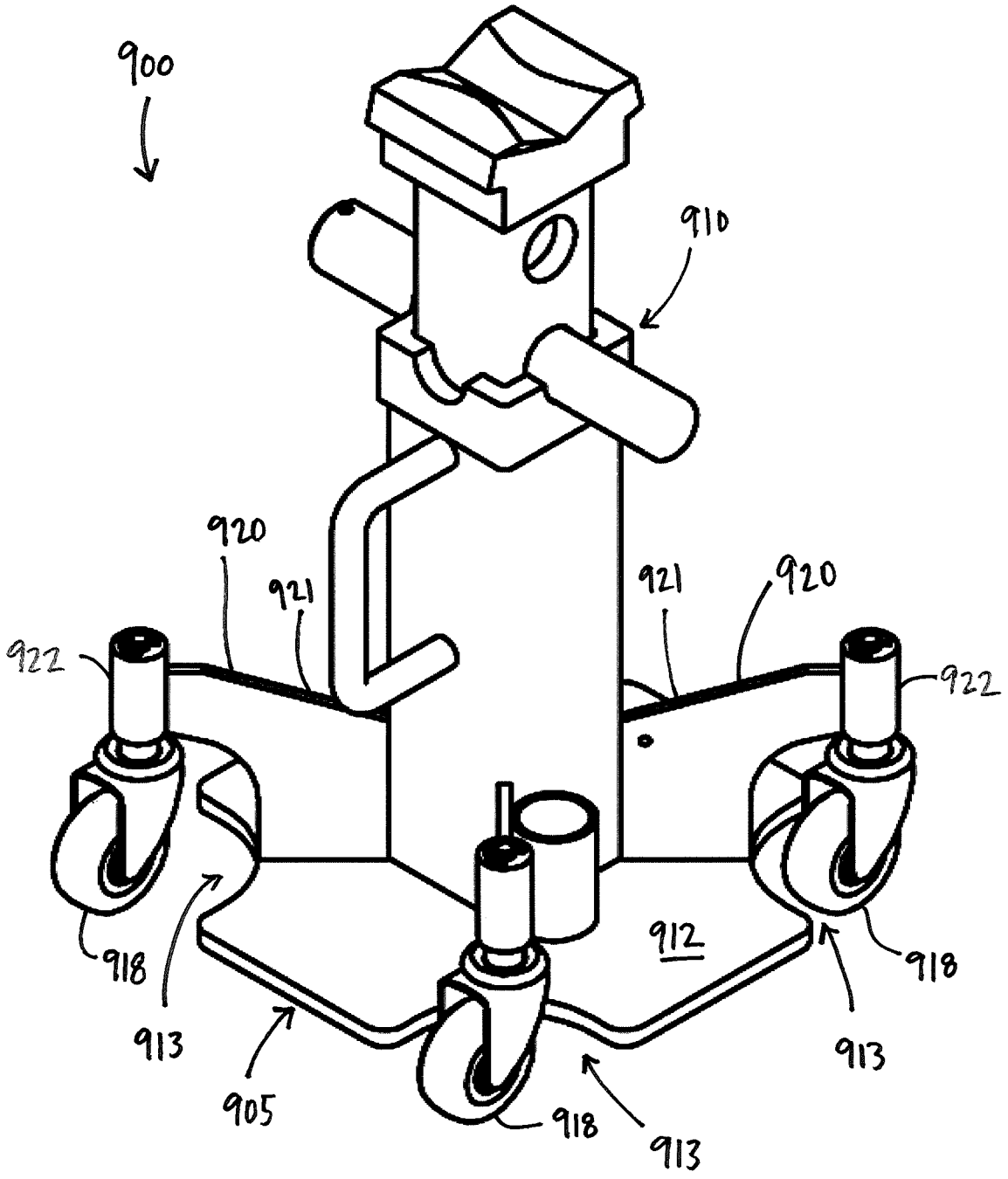
FIG. 9 is a perspective view of a vehicle support disposed on a base having a collapsible wheel assembly according to another embodiment of the invention.
Figure 10:
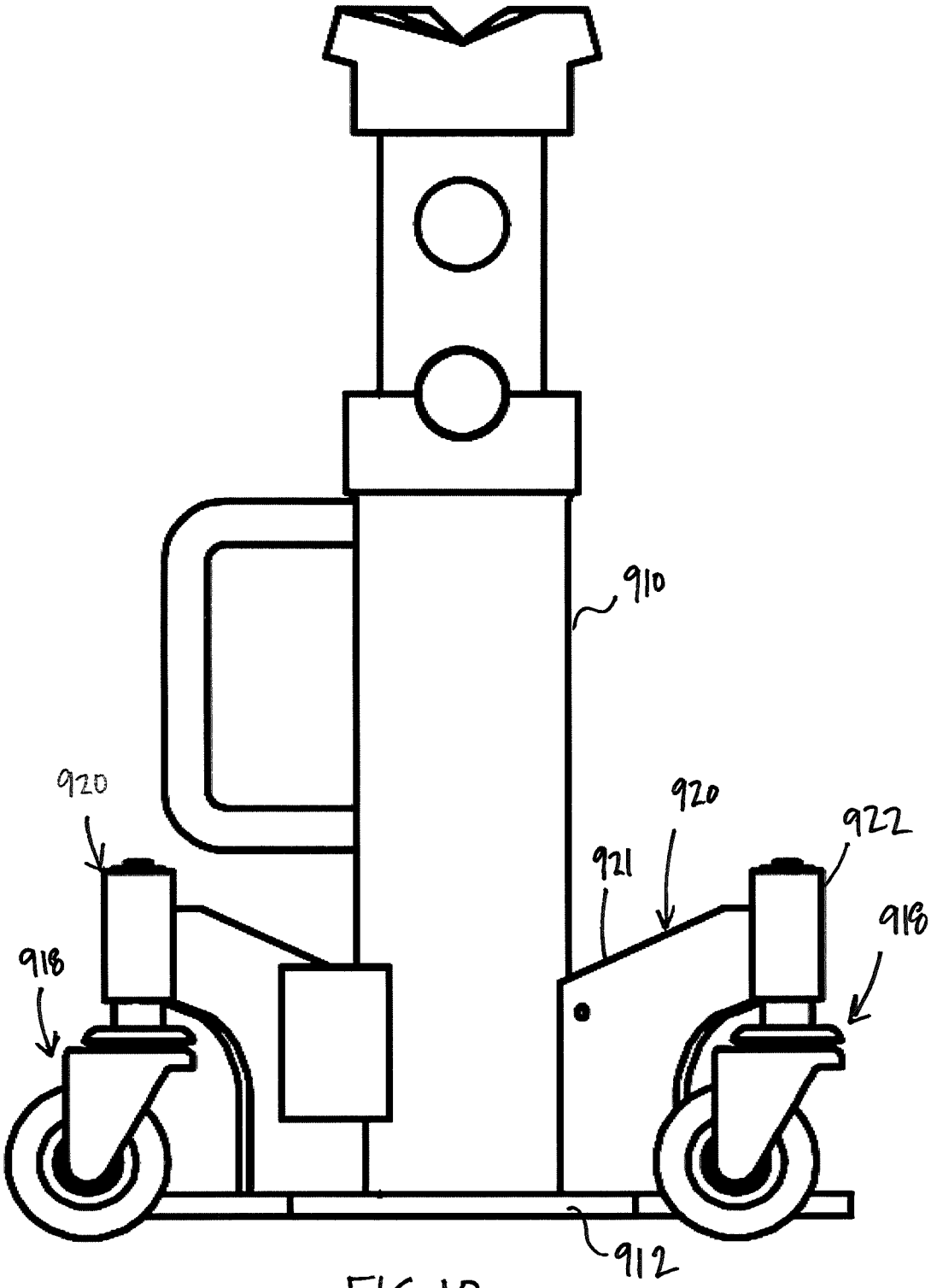
FIG. 10 is a side view of the vehicle support and base of FIG. 9.

Provided herein are embodiments of transportable base systems for vehicle supports, the base systems having collapsible wheels. FIGS. 1-8 illustrate a transportable jack and base system 100 having a base 105 and a jack 110. The jack 110 may be any type of jack, including but not limited to a bottle jacks, scissor jacks, transmission jacks, axle jacks, hydraulic lifts, post cylinders, or any other kind of jack, lift, or stand.

The base 105 comprises a base plate 112, a biasing member 114, and a wheel assembly 118 attached to the biasing member 114. In embodiments, the base 105 includes a plurality of biasing members 114 and wheel assemblies 118. The base plate 112 may take a variety of configurations. In one embodiment, the base plate 112 is hexagonal, although such a configuration is not required. Wheel openings 113 are formed into the base plate 112 such that the wheel assemblies 118 may pass through. Where the base plate 112 is hexagonal, the base plate 112 has six sides, and wheel openings 113 are formed into every other side. Therefore, three wheel openings 113 are formed into the base plate 112 for three wheel assemblies 118, thereby providing uniform support for the base. Additional, or fewer, wheel openings 113 and wheel assemblies 118 may be included. The wheel openings 113 may be may be configured as semicircular openings, square openings, or any other configuration which may allow the wheel assemblies 118 to pass there through.

The biasing member 114 is configured from a single piece of material and comprises a substantially horizontal top section 114A, a substantially horizontal bottom section 114C, and an angled section 114B disposed between the top and bottom sections 114A and 114C. The angle θ of the angled section 114B is between 0 and 60 degrees relative to horizontal, and preferably between 20 and 50 degrees relative to horizontal. The top portion 114A of the biasing member 114 attaches to a wheel assembly 118 via a fastener 116. Likewise, the bottom portion 114C of the biasing member 114 attaches to the base plate 112 via one or more fasteners 116.

Because vehicle supports 110 are quite heavy, the biasing member 114 must be strong enough to support the vehicle support 110 on the base plate 112 above the ground when the vehicle support 110 is not under load. However, the biasing member 114 must be formed of a material having sufficient flexibility to allow the wheel assemblies 118 to collapse under a load L. In embodiments, the biasing member 114 is formed from, for example, steel, aluminum, titanium, tungsten, or alloys of steel, aluminum, titanium, or tungsten. Other materials may alternately be utilized. Regardless of the material, importantly, the biasing member 114 is formed of one piece of material. The invention greatly simplifies previous designs which are prone to breaking down due to the many different components that make up the biasing system.

In one embodiment, the vehicle support 110 is removable from the base 105 and replaceable with a different vehicle support 110. Accordingly, the base 105 may be configured to support many different types of vehicle support 110. The vehicle support 110 may be temporarily secured to the base plate 112 to ensure that the vehicle support 110 does not slide on top of the plate 112.

In use, the jack and base system 100 is transported to the desired location by moving the system 100 along a ground surface via the wheel assemblies 118. When the system 100 is being transported, there is no load applied to the vehicle support 110, so the system 100 may freely move along the ground surface. When the system 100 is in the correct location, a load L (FIG. 7) is applied to the vehicle support 110. An equal and opposite force F is applied to the base 105 via the wheel assemblies 118, which causes the biasing member 114 to deform or flex under the load such that the base plate 112 comes into contact with the ground surface. Under the load L, the angle θ increases until a bottom surface of the base plate 112 touches the ground surface.

When the base plate 112 comes into contact with the ground, the base 105 is prohibited from moving along the ground. When the load L is removed from the vehicle support 110, the biasing members 114 again bias the wheel assemblies 118 toward the ground surface such that the jack and base system 100 is again transportable via the wheel assemblies 118.

FIGS. 9-12 illustrate an alternate embodiment of a transportable jack and base system 900 having a base 905 and a vehicle support 910. As with vehicle support 110, vehicle support 910 may be any type of jack, including but not limited to a bottle jacks, scissor jacks, transmission jacks, axle jacks, hydraulic lifts, jack stands, post cylinders, or any other kind of vehicle support.

The base 905 comprises a base plate 912, and a wheel assembly 918 attached to the base plate 912 via a connection member 920. In embodiments, the base 905 includes a plurality of connection members 920 and wheel assemblies 918. The base plate 912 may take a variety of configurations. In one embodiment, the base plate 912 is square, although such a configuration is not required. Wheel openings 913 are formed into the base plate 912 such that the wheel assemblies 918 may pass through. Where the base plate 912 is square, the base plate 912 has four sides, and wheel openings 913 are formed into the corners. Therefore, four wheel openings 913 are formed into the base plate 912 for four wheel assemblies 918, thereby providing uniform support for the base. Additional, or fewer, wheel openings 913 and wheel assemblies 918 may be included. The wheel openings 913 may be may be configured as semicircular openings, square openings, or any other configuration which may allow the wheel assemblies 918 to pass there through.

The connection member 920 comprises a base portion 921 and a socket 922. The base portion 921 connects the base 905 to the wheel assembly 918. Specifically, the base portion 921 is attached (e.g., welded) to the base plate 912. The base portion 921 may further contact the vehicle support 910, and may provide additional stability to the vehicle support 910. The socket 922 extends from the base portion 921 to engage with the wheel assembly 918.

Figure 11:
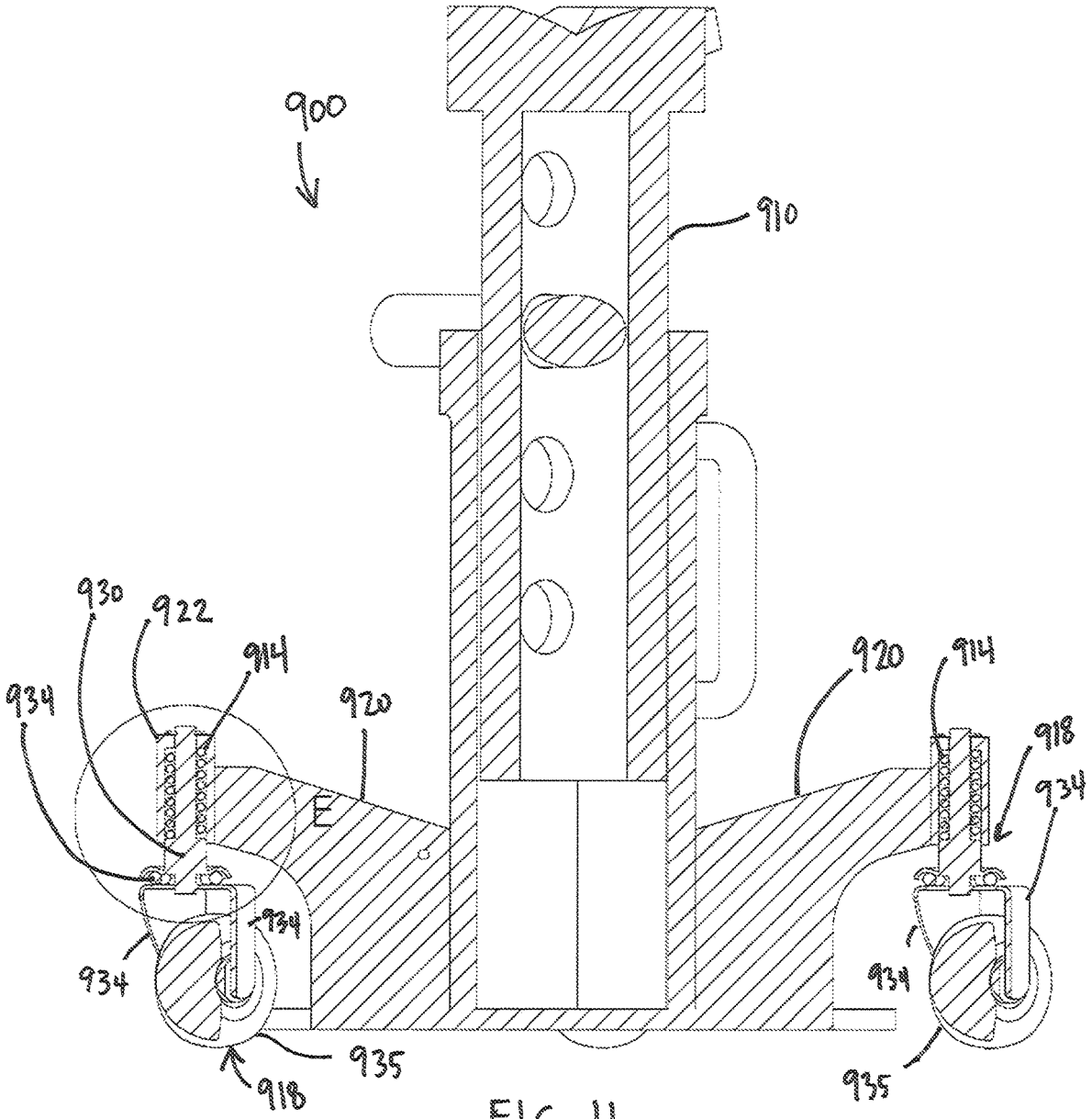
FIG. 11 is a cross-section view of the vehicle support and base of FIG. 9.
Figure 12:
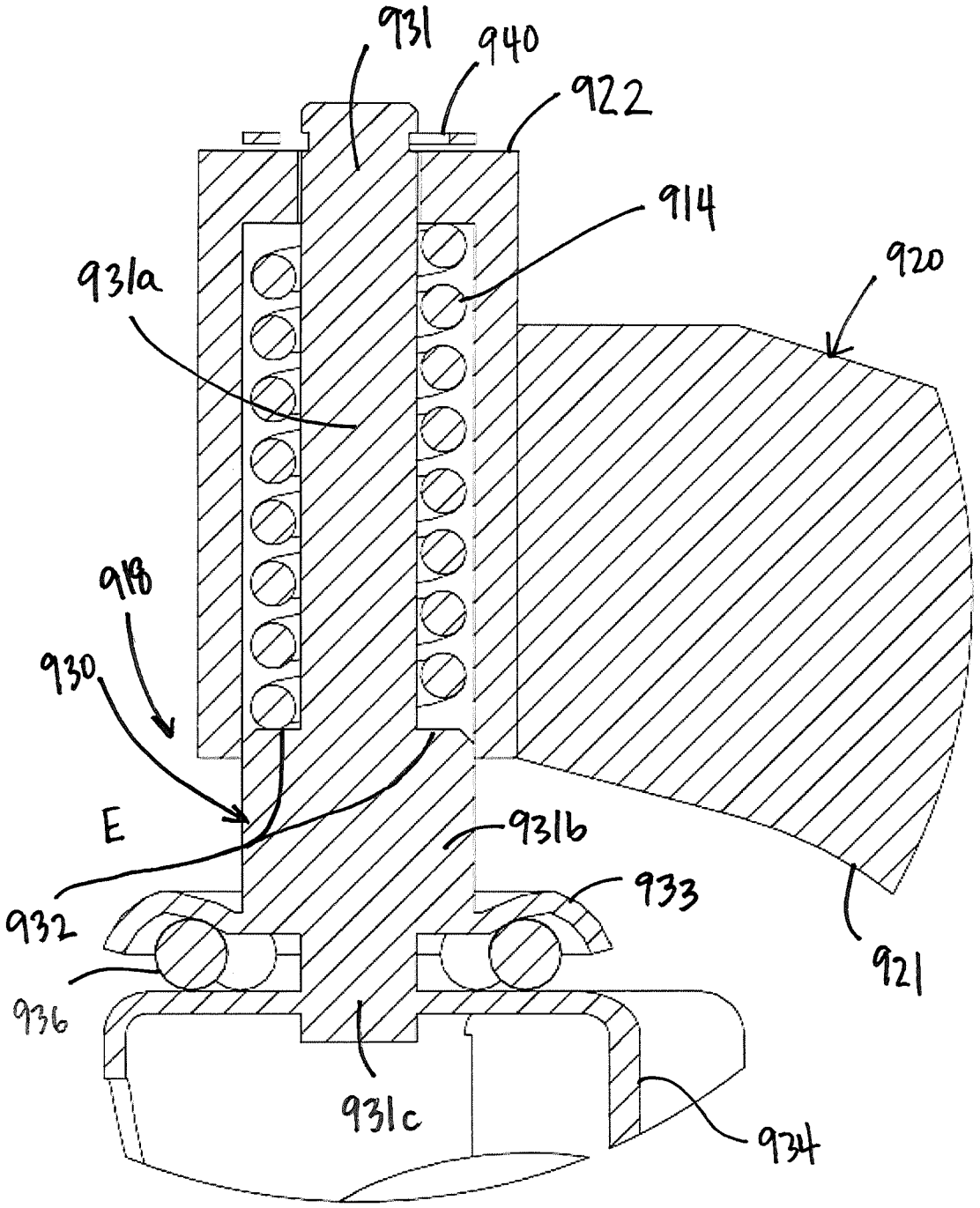
FIG. 12 is a cross-section detail view of the wheel assembly of FIG. 11.

Referring specifically to FIGS. 11 and 12, the wheel assembly 918 includes a wheel bracket 930 having a post 931 with a first portion 931*a*, a second portion 931*b*, and a third portion 931*c*. The first portion 931*a* extends freely through an opening in the socket 922. A stop 940 extending from the first portion 931*a* prevents the wheel assembly 918 from detaching from the socket 922.

A shoulder 932 is formed between the first portion 931*a* and the second portion 931*b*. A guard 933 extends from the second portion 931*b*. Attachment arms 934 extend around the third portion 932*c* and engage with a wheel 935. Bearings 936 are disposed between the guard 933 and the attachment arms 934. The guard 933 holds the bearings 936 in place while the bearings 936 allow the attachment arms 934, and therefore the wheel 935, to rotate. A biasing member 914 (e.g., a helical spring) is disposed around the first portion 931*a* of the post and rests atop the shoulder 932.

In one embodiment of the invention, the vehicle support 910 is removable from the base 905 and replaceable with a different vehicle support 910. Accordingly, the base 905 may be configured to support many different types of vehicle support 910. The vehicle support 910 may be temporarily secured to the base plate 912 to ensure that the vehicle support 910 does not slide on top of the plate 912.

In use, the jack and base system 900 is transported to the desired location by moving the system 900 along a ground surface via the wheel assemblies 918. When the system 900 is being transported, there is no load applied to the vehicle support 910, so the system 900 may freely move along the ground surface. When the system 900 is in the correct location, a load is applied to the vehicle support 910. The load on the vehicle support 910 causes the base 905, and consequently the connection members 920, to collapse. The socket 922 presses down on the biasing member 914, which compresses the biasing member 914 between the shoulder 932 and the socket 922. The biasing member 914 is compressed until the base plate 912 contacts the ground.

When the base plate 912 comes into contact with the ground, the base 905 is prohibited from moving along the ground. When the load is removed from the vehicle support 910, the biasing members 914 expand such that the jack and base system 900 is again transportable via the wheels 935.

Many different arrangements of the described invention are possible without departing from the spirit and scope of the present invention. Embodiments of the present invention are described herein with the intent to be illustrative rather than restrictive. Alternative embodiments will become apparent to those skilled in the art that do not depart from its scope. A skilled artisan may develop alternative means of implementing the disclosed improvements without departing from the scope of the present invention.

Further, it will be understood that certain features and subcombinations are of utility and may be employed without reference to other features and subcombinations and are contemplated within the scope of the claims. Not all steps listed in the various figures and description need to be carried out in the specific order described. The description should not be restricted to the specific described embodiments.

What is claimed is:

1. A transportable jack system, comprising:

a jack disposed on a base, the base comprising:

a base plate having a plurality of wheel openings formed therein; and a biasing member disposed between a wheel and the base plate;

wherein:

the biasing member comprises configured from a single piece of material consisting of a horizontal top portion, a horizontal bottom portion, and an angled middle portion disposed between the top horizontal portion and the bottom horizontal portion;

the biasing member biases the base plate away from a ground surface when a load applied to the jack is below a predetermined threshold; and the biasing member deforms when the load is above the predetermined threshold, wherein the deformation allows the base plate to contact the ground surface.

2. The system of claim 1, wherein the biasing member is steel.

3. The system of claim 1, wherein the base plate is hexagonal.

4. The system of claim 3, wherein the wheel openings are formed into every other side of the hexagonal base plate.

5. The system of claim 4, wherein the wheel openings are semi-circular.

6. The system of claim 1, wherein the angle of the angled portion of the biasing member is between 20 and 50 degrees relative to horizontal when the load applied to the jack is zero.

7. The system of claim 1, wherein the jack is removably attached to the base plate.

8. The system of claim 7, wherein the jack is selected from the list consisting of a bottle jack, a scissor jack, a transmission jack, an axle jack, and a jack stand.

9. A transportable base for a vehicle lift or jack, comprising:

a base plate having at least one wheel opening formed therein;

a biasing member disposed between a wheel and the base plate and secured to the base plate via a mechanical fastener;

wherein:

the biasing member consists of one piece of material forming a substantially horizontal top portion, a substantially horizontal bottom portion; and an angled middle portion between the top and bottom portions;

the biasing member biases the base plate away from a ground surface when a load applied to the base plate is below a predetermined threshold; and the biasing member deforms when the load applied to the base plate is above the predetermined threshold such that the base plate comes into contact with the ground surface.

10. The base of claim 9, wherein the base plate comprises a plurality of wheel openings.

11. The base of claim 10, wherein the wheel openings are semi-circular.

12. The base of claim 11, wherein the wheel is disposed within the wheel openings.

13. The base of claim 9, wherein the angle of the angled portion of the biasing member is between 20 and 50 degrees relative to horizontal when the load applied to the jack is zero.

14. The base of claim 9, further comprising a jack removably attached to the base plate.

15. The base of claim 14, wherein the jack is selected from the list consisting of a bottle jack, a scissor jack, a transmission jack, an axle jack, and a jack stand.

16. A transportable base for a vehicle lift or jack, comprising:

a base plate;

a connection member coupled to the base plate, the connection member comprising a base portion and a socket;

a wheel assembly comprising:

a post having a shoulder;

an attachment arm extending at least partially around the post;

a wheel coupled to the attachment arm; and a biasing member;

wherein:

the post extends through an opening in the socket;

the biasing member is disposed between the shoulder and the socket and biases the wheel away from a ground surface when a load applied to the base plate is below a predetermined threshold; and the biasing member compresses when the load applied to the base plate is above the predetermined threshold such that the base plate comes into contact with the ground surface.

17. The base of claim 16, wherein the base plate comprises a plurality of wheel openings formed therein.

18. The base of claim 16, wherein the wheel assembly further comprises a guard extending from the post, at least one bearing being disposed between the attachment arm and the guard to allow rotation of the attachment arm relative to the post.

19. The base of claim 16, wherein the post comprises a stop, the stop preventing the post from breaking away from the socket.

20. The base of claim 19, wherein the base comprises a wheel opening, the wheel assembly being positioned within the wheel opening.

* * * * *